US010718137B2

(12) United States Patent
Scheffler et al.

(10) Patent No.: US 10,718,137 B2
(45) Date of Patent: Jul. 21, 2020

(54) SWIVEL LOCK SYSTEM WITH MANUAL OVERRIDE AND DRIVE POSITION CONTROL

(71) Applicant: Hanchett Entry Systems, Inc., Phoenix, AZ (US)

(72) Inventors: Dominik Scheffler, Phoenix, AZ (US); Dewey David, Glendale, AZ (US); Michael Allen Webb, Cave Creek, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 414 days.

(21) Appl. No.: 15/651,723

(22) Filed: Jul. 17, 2017

(65) Prior Publication Data

US 2017/0314293 A1 Nov. 2, 2017

Related U.S. Application Data

(62) Division of application No. 14/246,311, filed on Apr. 7, 2014, now Pat. No. 9,708,833.

(Continued)

(51) Int. Cl.
*E05B 47/00* (2006.01)
*E05B 47/06* (2006.01)

(Continued)

(52) U.S. Cl.
CPC ..... *E05B 47/0012* (2013.01); *E05B 1/0092* (2013.01); *E05B 5/00* (2013.01);

(Continued)

(58) Field of Classification Search
CPC .. E05B 63/0069; E05B 47/0012; E05B 81/06; E05B 81/90; E05B 47/0692;

(Continued)

(56) References Cited

U.S. PATENT DOCUMENTS 4,257,634 A * 3/1981 Kleefeldt ..... E05B 81/25 292/201
4,986,098 A * 1/1991 Fisher ..... E05B 81/06 292/201

(Continued)

FOREIGN PATENT DOCUMENTS

DE 20 2007 009 513 U1 10/2007
EP 1 253 266 A2 10/2002
WO WO2008140944 A1 11/2008

OTHER PUBLICATIONS

Viethen, Lorenz, "European Office Action", May 7, 2019 for Application No. 14020050.2, European Patent Office, Munich, Germany.

(Continued)

*Primary Examiner* — Mark A Williams
(74) *Attorney, Agent, or Firm* — Woods Oviatt Gilman LLP; Ronald J. Kisicki, Esq.

(57) ABSTRACT

A swivel lock assembly with electronic and manual actuating means to unlock a handle thereby permitting access to the interior of the cabinet wherein the manual actuator can override the electronic actuator and vice versa. When in a locked position, the handle rests within lock housing such that the handle engages a blocker mounted within the housing. To unlock the handle, the blocker is manipulated by electronic or manual actuation such that the handle is no longer constrained and can be swung away from the housing about a handle pivot.

2 Claims, 16 Drawing Sheets

Related U.S. Application Data

(60) Provisional application No. 61/810,120, filed on Apr. 9, 2013.

(51) Int. Cl.
*E05B 1/00* (2006.01)
*E05B 5/00* (2006.01)

(52) U.S. Cl.
CPC .. *E05B 47/0657* (2013.01); *E05B 2047/0023* (2013.01); *Y10T 70/7102* (2015.04); *Y10T 292/57* (2015.04)

(58) Field of Classification Search
CPC ..... E05B 2047/0023; E05B 81/34; E05B 2047/0016; E05B 47/0673; E05B 2047/002; E05B 2047/0036; E05B 81/28; Y10T 292/1082; Y10T 292/1021
See application file for complete search history.

(56) References Cited

U.S. PATENT DOCUMENTS 5,440,905 A * 8/1995 Yamada ..... E05B 5/003 292/202
5,472,065 A * 12/1995 Vergin ..... E05B 81/25 185/40 R
5,722,272 A * 3/1998 Bridgeman ..... E05B 81/16 70/264
7,584,634 B2 * 9/2009 Hoffman ..... E05B 5/00 292/336.3
7,681,424 B2 * 3/2010 Antonucci ..... E05B 1/0092 292/207
2009/0007610 A1 * 1/2009 Hoffmann ..... E05B 1/0092 70/192
2014/0300117 A1 * 10/2014 Scheffler ..... E05B 47/0012 292/336.3

OTHER PUBLICATIONS

Viethen, Lorenz, "European Office Action", Nov. 6, 2018 for Application No. 14020050.2, European Patent Office, Munich, Germany.

Cruyplant, Lieve, "European Search Report", search completed Jul. 16, 2015, dated Nov. 19, 2015 for European Application No. 14020050.2, The Hague.

* cited by examiner

SWIVEL LOCK SYSTEM WITH MANUAL OVERRIDE AND DRIVE POSITION CONTROL

RELATIONSHIP TO OTHER APPLICATIONS AND PATENTS

The present application is a divisional of U.S. patent application Ser. No. 14/246,311, filed on Apr. 7, 2014, now U.S. Pat. No. 9,708,833, which claims the benefit of U.S. Provisional Patent Application No. 61/810,120, filed Apr. 9, 2013, the contents of which are incorporated by reference in their entirety

TECHNICAL FIELD

The present invention relates to swivel lock assemblies that are used, for example, to secure cabinets, such as cabinets for storing computer servers, and more particularly to swivel lock assemblies having manual and electronic actuating mechanisms wherein the manual actuator can override a locked state of the electronic actuator and the electronic actuator can override a locked state of the manual actuator.

BACKGROUND OF THE INVENTION

There currently exists in the market locking systems for cabinet doors, such as those used to secure computer server cabinets, which have two or more locking mechanisms incorporated within the locking system. These locking systems prevent unwanted access to the interior of the cabinet. Typically, a latch secures the cabinet door, with release of that latch dependent upon presentation of proper verification, such as through a key card for electronic actuation or through a key for manual actuation. Upon proper verification, a handle of the locking system is released and, once released, the handle can be turned or swiveled to release the latch.

While there exists many locking systems within the art, the present invention achieves advantages not taught or suggested by the prior art. For example, U.S. Pat. No. 7,681,424 teaches a swivel lock system of this type having a shuttle that is driven by a solenoid in a first direction to secure the handle and in a second direction to release the handle. A stop, whose position is controlled by turning of a manual actuator, either permits the shuttle to move or blocks the shuttle from moving. When the shuttle is blocked from movement to secure the handle, the solenoid cannot move the shuttle from its blocked position to release the handle. The present invention, as described in two embodiments, overcomes this shortfall and other shortfalls existing in the art.

SUMMARY OF THE INVENTION

In one aspect of the invention, a cabinet locking assembly is provided which enables both electronic and manual actuation of the locking mechanism wherein the manual actuator can override the electronic actuator and the electronic actuator can override the manual actuator. In a first embodiment, a pivoting blocker is provided to selectively release the handle. In a second embodiment, a sliding blocker is provided to selectively release the handle.

In another aspect of the invention, a spring is provided with the manual actuator wherein the actuator has self-centering mechanics to allow an activated lock cam to be automatically returned to a locked state upon release of the handle without external manipulation.

In yet another aspect of the invention, the drive mechanism coupled to the electronic actuator automatically disengages the drive motor from the drive mechanism after a predetermined length of travel of the mechanism irrespective of continued operation of the motor. Thus, the rotational position of the motor's drive shaft does not have to be precisely monitored.

In yet another aspect of the invention, an interchangeable lock core is incorporated as the manual actuator. A master key is provided so that the lock core may be removed from its housing, thereby making the lock tumblers accessible. This feature provides added versatility to the design so that an entire array of cabinets as well as an entire building can be secured or made accessible, using a single key.

In yet another aspect of the invention, the swivel end of the handle is secured to the housing without the use of a fastener such as a pin. The mating securing features are net-formed in the handle and yoke so that a fastener or additional machining to the components is not needed.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
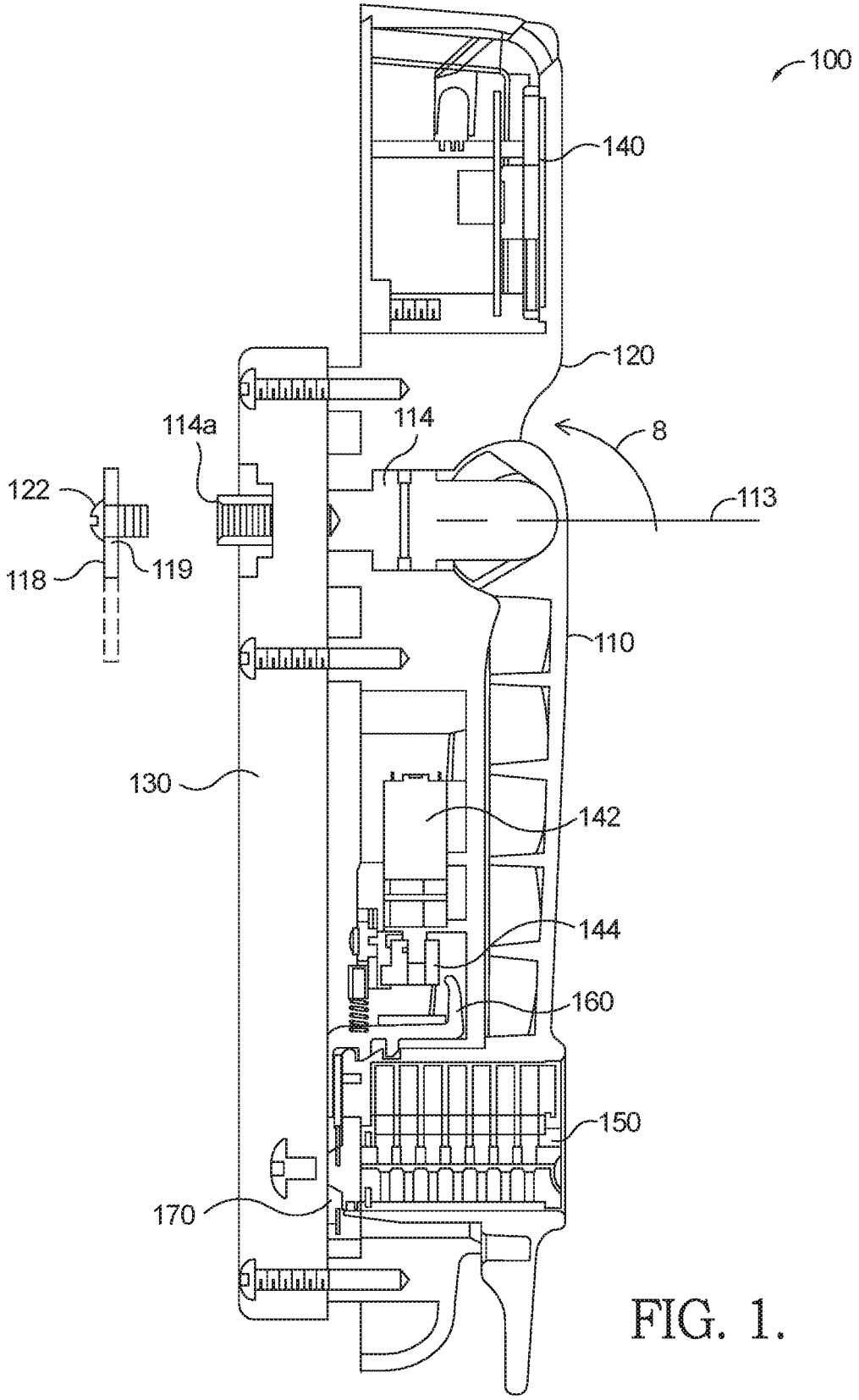
FIG. 1 is a cross sectional view from the side of a first embodiment of a swivel lock system.
Figure 2:
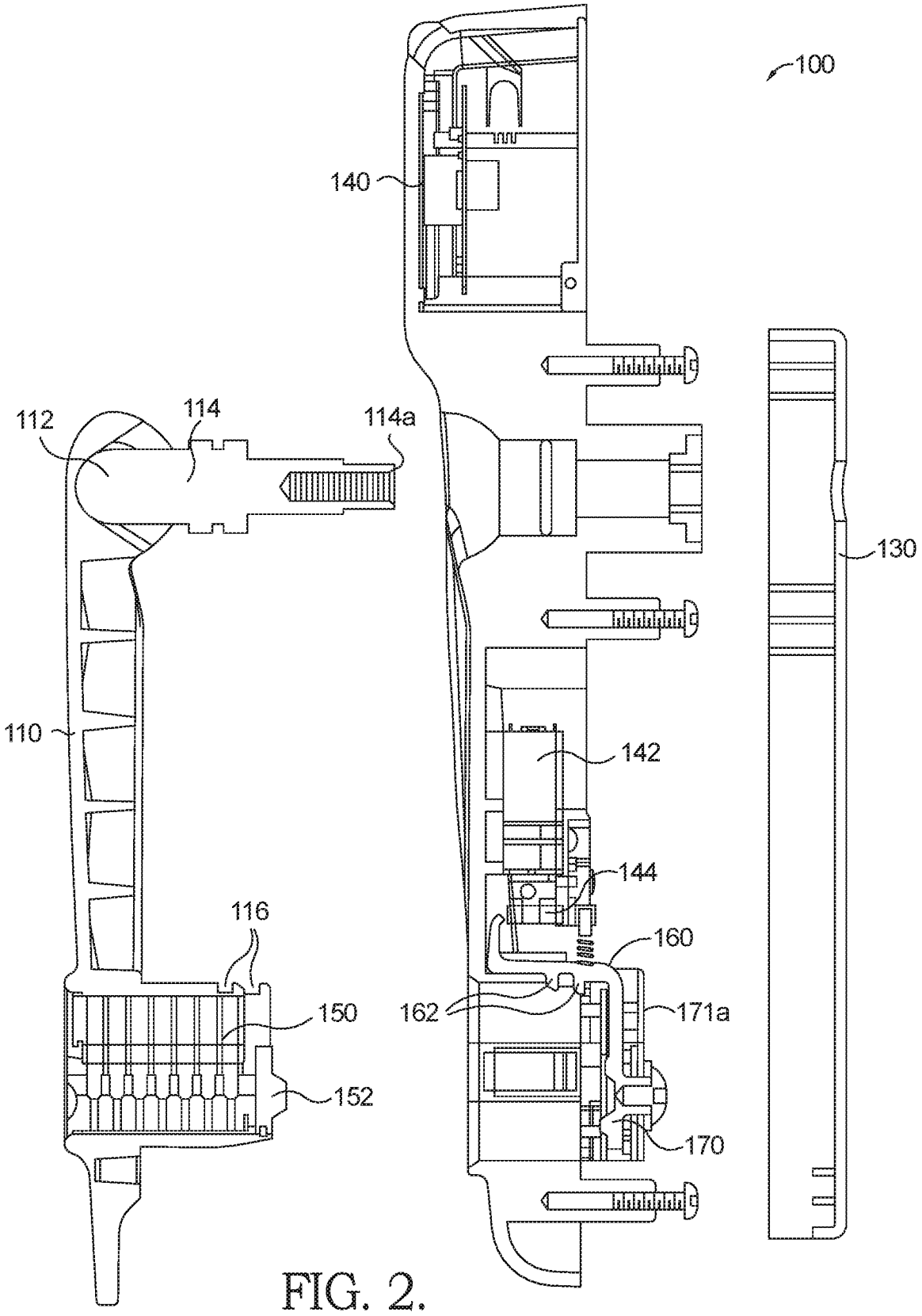
FIG. 2 is an exploded cross sectional side view of a first embodiment of a swivel lock system.

A first embodiment 100 of a swivel lock assembly with manual override is generally shown in FIGS. 1 and 2. Lock assembly 100 is generally comprised of a handle 110 pivotally mounted to a lock housing 120 at handle pivot 112. When in a locked position, handle 110 generally rests within lock housing 120 such that a first locking member, such as, for example, locking grooves 116 on handle 110 engage with a second locking member, such as, for example, locking teeth 162, of blocker 160 mounted within housing 120. To unlock the handle, locking teeth 162 are moved by electronic or manual actuation such that locking grooves 116 are no longer constrained by locking teeth 162 and handle 110 can be swung away from the housing about handle pivot 112 in a rotational path generally shown as 8 in FIG. 1. Handle pivot 112 includes swivel axis 113 and incorporates a drive yoke 114 which passes through housing 120. The distal end 114*a* of yoke 114 may be square in cross section. Latch 118 includes a similarly shaped square hole 119, adapted to be attached to distal end 114*a* of the drive yoke by threaded fastener 122 wherein, when the handle is in a locked position (as shown in FIG. 1), latch 118 engages with a locking member within the cabinet housing such that the cabinet door is prevented from opening. When the lock is in an unlocked position and the handle is sufficiently pivoted about swivel axis 113, the latch 118 is rotated such that the latch is no longer impeded by the locking member within the cabinet thereby allowing the cabinet door to be opened to access the cabinet interior.

Housing 120 contains electrical and mechanical components of the locking system with a majority of these components being accessible by removal of back cover 130. Specifically, housing 120 integrates an electronic control unit 140 which energizes an electronic actuator such as motor 142, which may be a DC motor, to rotate motor cam 144 upon verification of input of proper identification at the control unit 140. Electronic control unit 140 may be any suitable device known in the art, such as but not limited to a swipe card reader, key card scanner, key fob reader, fingerprint or retinal scanner, or voice recognition system. As discussed in more detail below with reference to the appropriate figures, motor cam 144 includes a high lobe that, once rotated by the energized motor, impinges upon blocker 160 thereby causing locking teeth 162 to disengage from locking grooves 116.

Handle 110 further incorporates a manual actuator, such as, for example, a lock core 150, which allows for manual manipulation of blocker 160 to enable locking teeth 162 to disengage from locking grooves 116 on the handle. In one aspect of the invention, lock core 150 may be a small format interchangeable core "(SFIC"). With an SFIC, a master key is provided so that the lock core may be readily removed from its housing to access the lock tumblers. The tumblers may then be refitted so that a number of locks may be operated with a single key.

Figure 3:
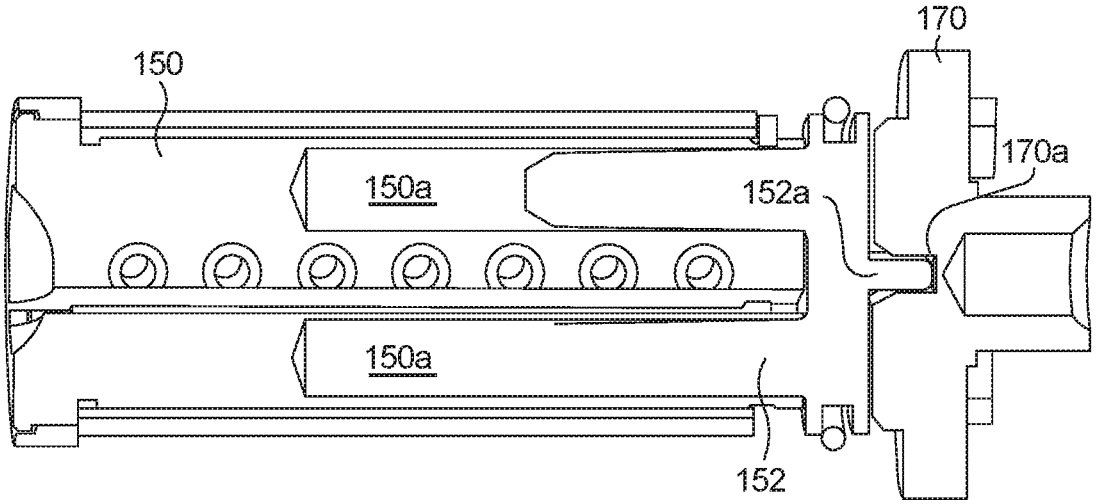
FIG. 3 is an isolated cross sectional view of a lock core and lock cam used in a first embodiment of a swivel lock system.

Lock core 150 is equipped with a coupler 152 that engages with a lock cam 170 such that rotation of the lock core (i.e. by manually turning a key) rotates the coupler 152, and also rotates the lock cam 170 thereby causing lock cam 170 to operate on blocker 160. As shown in greater detail in FIG. 3, lock core 150 has a pair of channels 150*a* which engage with coupler 152 so that turning of the lock core translates into turning of the coupler. Coupler 152 has a tab 152*a* which, when properly oriented, mates within a slot 170*a* of lock cam 170. Thus, when tab 152*a* is engaged with slot 170*a*, rotation of the lock core and coupler results in rotation of the lock cam. Importantly, coupler 152 and lock core 150 are secured within the handle 110 while the lock cam is mounted within housing 120. Thus, lock core 150 remains affixed to the handle at all times and does not remain within the housing when the handle is pivoted in the unlocked state. For this reason, as will be described in more detail below, a means for assuring that tab 152*a* will properly engage slot 170*a* when the handle is brought back to its secured position in the housing must be provided.

Figure 4:
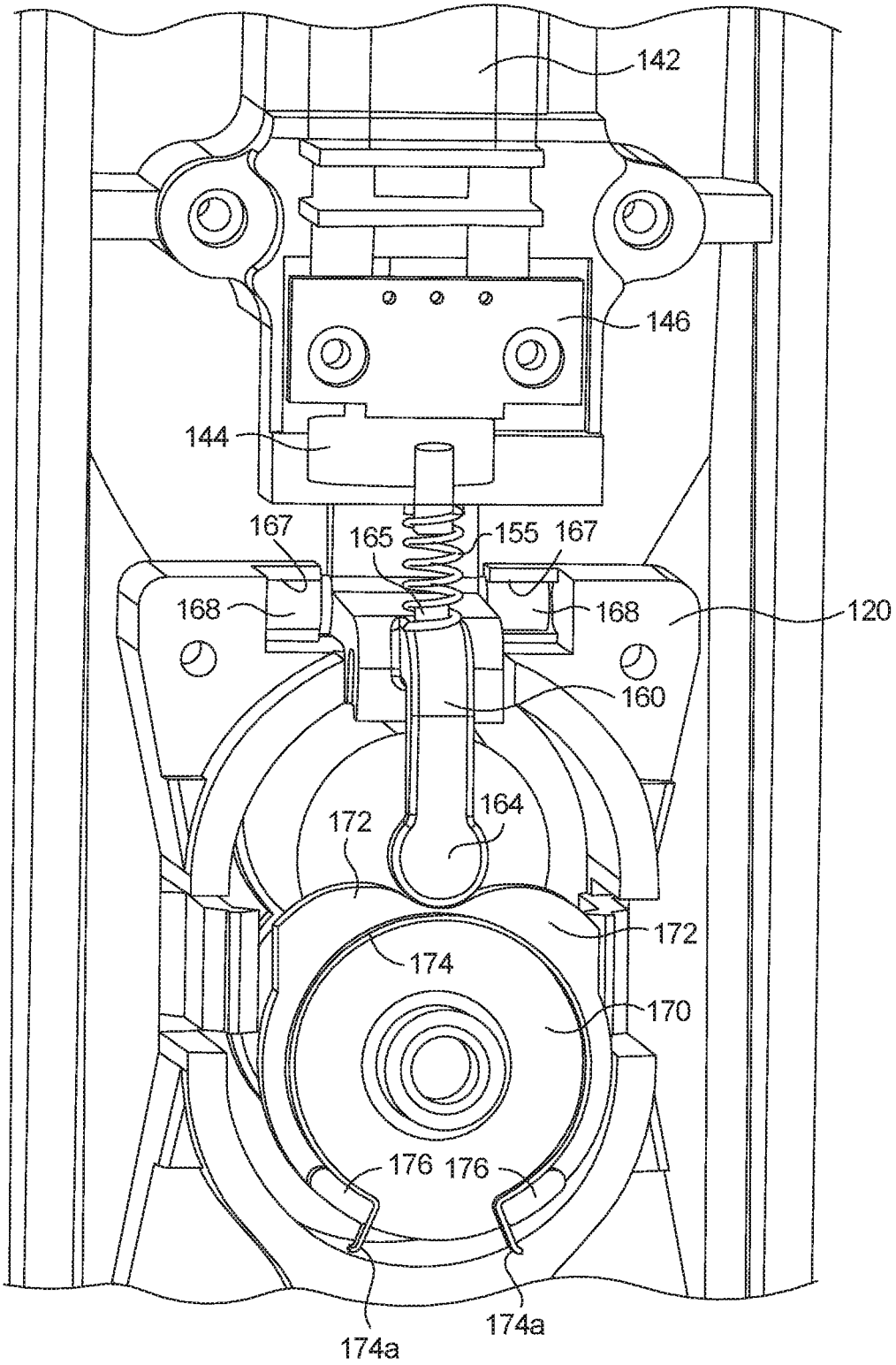
FIG. 4 is a detailed view of the locking mechanism of a first embodiment of a swivel lock system showing the mechanism in a locked state.
Figure 5:
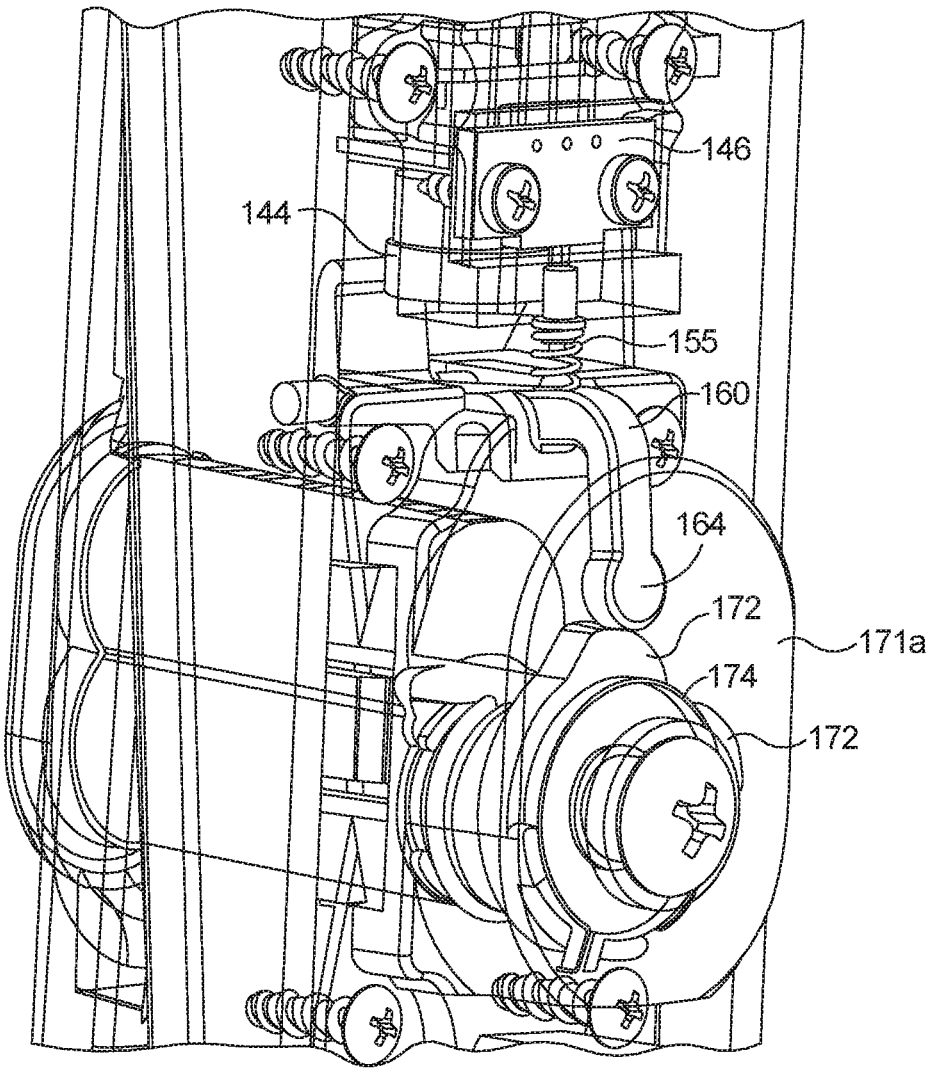
FIG. 5 is a detailed view of the locking mechanism of a first embodiment of a swivel lock system showing the lock cam mechanism in an unlocked state using the manual actuator.
Figure 6:
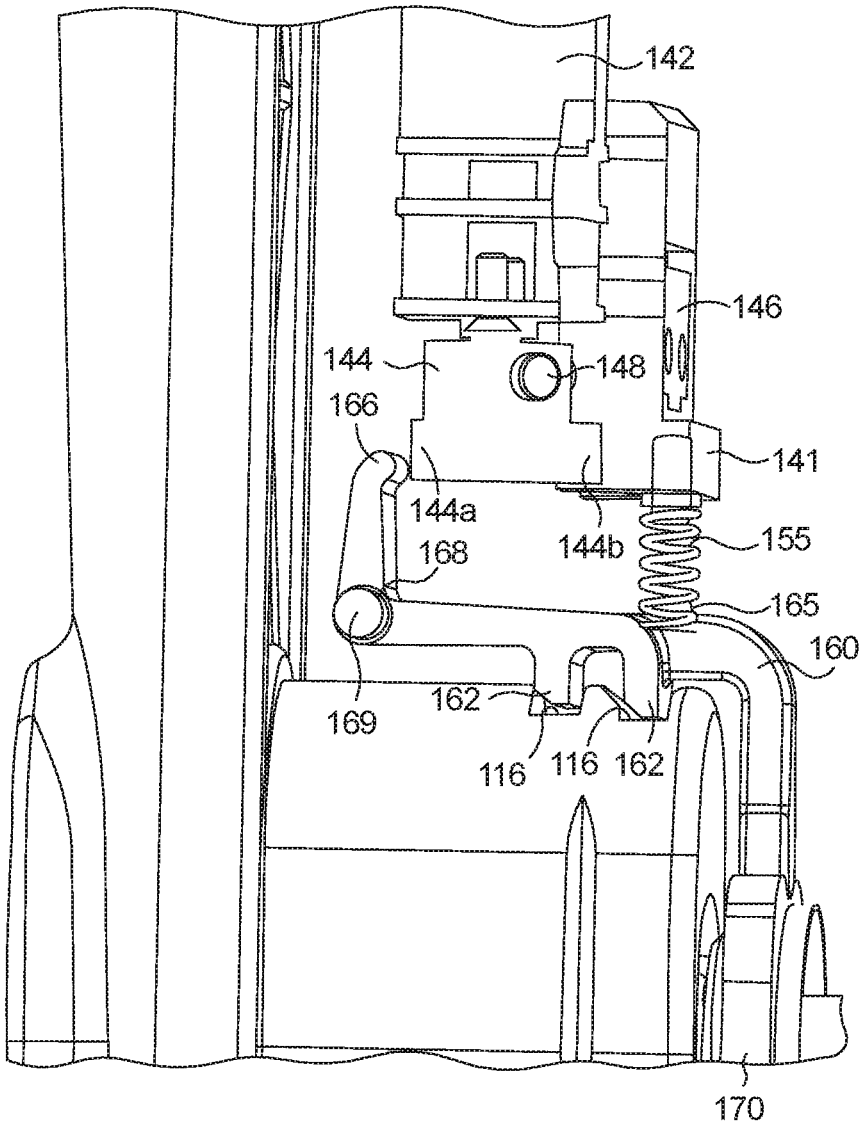
FIG. 6 is a detailed side view of the locking mechanism of a first embodiment of a swivel lock system showing the mechanism in a locked state.

Turning now to FIGS. 4 through 7, a detailed view of the locking features is shown. As shown in FIGS. 4 and 6, blocker 160 includes pivot shaft 168. In operation, blocker 160 pivots about shaft axis 169 to move between a blocking position and an unblocking position. Pivot shaft 168 is received in cradles 167 formed in housing 120. Pivot shaft 168 is constrained in cradles 167 when cam retainer cover 171*a* is secured to the housing (see FIG. 2). Cam retainer cover 171*a* will be discussed in more detail with regard to FIG. 8. Housing 120, along with cam retainer cover 171*a*, envelop blocker pivot shaft 168 such that blocker 160 pivots within the housing upon engagement with lock cam 170 or motor cam 144. Housing 120 and cam retainer cover 171*a* have been omitted from FIG. 6 so as to improve clarity of operation of blocker 160 with regard to cams 170 and 144.

As seen more clearly in FIG. 4, lock cam 170 comprises cam lobes 172 positioned along either side of a rounded head portion 164 of blocker 160. In this embodiment, lobes are located on either side of the head so as to enable either left hand or right hand rotation of the lock core. It is envisioned that lock cams may be manufactured with a single cam for solely left hand or right hand rotation and are considered to be within the scope of the present invention.

As seen in FIG. 5, rotation of the lock core (such as by turning of a key), as described above, causes rotation of lock cam 170 such that either the left hand or right hand cam lobe 172 engages blocker head 164. Continued rotation of the cam presses upward upon blocker head 164 causing blocker 160 to pivot about axis 169 and to move towards its unblocking position. With sufficient turning of the key, and by extension the cam lobe, blocker 160 pivots such that locking teeth 162 disengage from locking grooves 116 on the handle 110. Once the teeth have disengaged, the handle is free to lift off of its engagement with the base 120 and then pivot in rotational direction 8 and then rotate about axis 113 (FIG. 1), thereby unlocking the cabinet door. A blocker spring 155 mounted to post 165 biases blocker 160 to the blocking position (as shown in FIG. 4) once the lock cam 170 is returned to its neutral position by action of cam spring 174 as discussed below.

Figure 8:
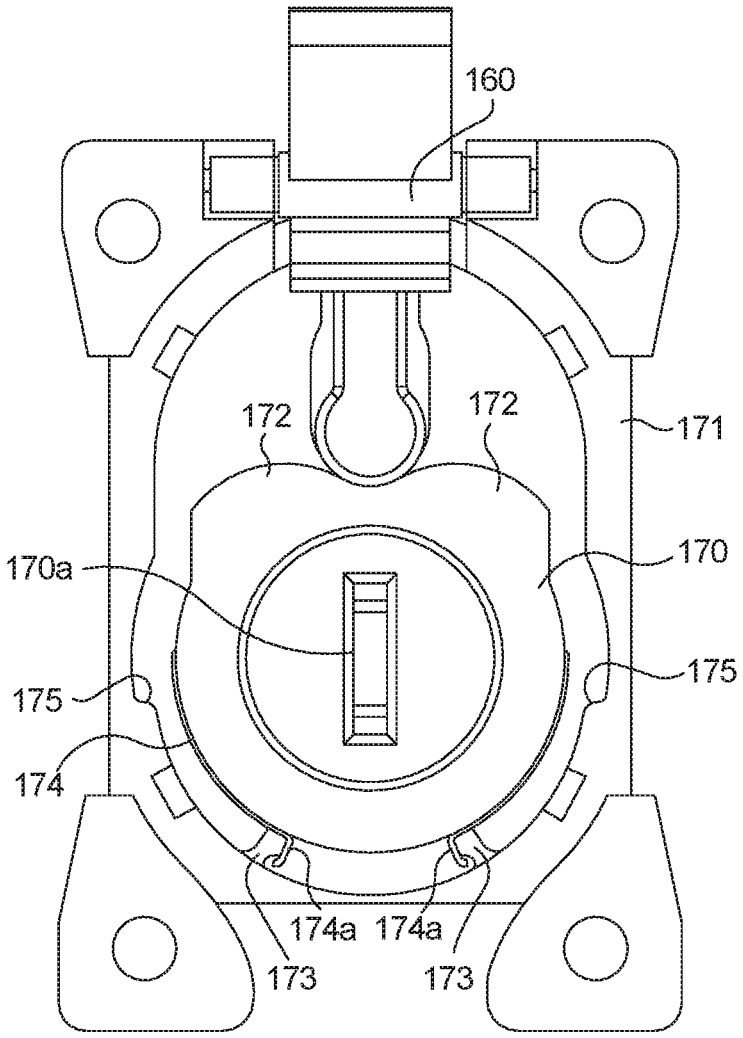
FIG. 8 is a detailed view of the a lock cam and retainer of a first embodiment of a swivel lock system showing the mechanism in a locked state and the self-centering return spring.

It is one aspect of the present invention, a lock cam which is self-centering once the force applied by the turning of a key is removed, is provided. This is necessary to assure that tab 152*a* of coupler 152 will properly engage slot 170*a* of lock cam 170 when the handle is brought back to its secured position in the housing. Self-centering of the lock cam 170 is provided by the interaction of cam spring 174 with cam posts 176 and retainer nodules 173 of cam retainer 171 (see FIG. 8). As discussed above, turning of a key within the lock core causes lock cam 170 to rotate. As cam 170 rotates away from its centered position, cam spring 174 is induced to rotate by action of cam post 176 pushing upon one of the terminal arms 174*a* of the cam spring (FIG. 4). Free rotation of cam spring 174 is prevented, however, as the other terminal arm 174*a* is restrained by a retainer nodule 173 on cam retainer cover 171*a* (FIG. 8). Thus, the turning force applied to a key and lock cam 170 stores a reacting spring force in cam spring 174. Once the turning force on the key/cam is removed, the spring force stored within the cam spring is released causing the lock cam 170 to return to its centered (i.e. locked) position. Thus, once the handle (and by extension the lock core) is released from the housing, the lock cam returns to its neutral, non-rotated position. In this manner, coupler slot 170*a* is also returned to its non-rotated position such that coupler tab 152*a* properly engages slot 170*a* when the handle is returned to the housing.

As further seen in FIG. 8, cam retainer 171 is further configured with rotation restrictors 175 to prevent over-rotation of the lock cam upon turning of the lock core. The rotation restrictors are sized and positioned such that the leading edge of a respective cam lobe 172 buts against the lower wall of the restrictor once the lock cam has been rotated approximately 90 degrees.

Figure 7:
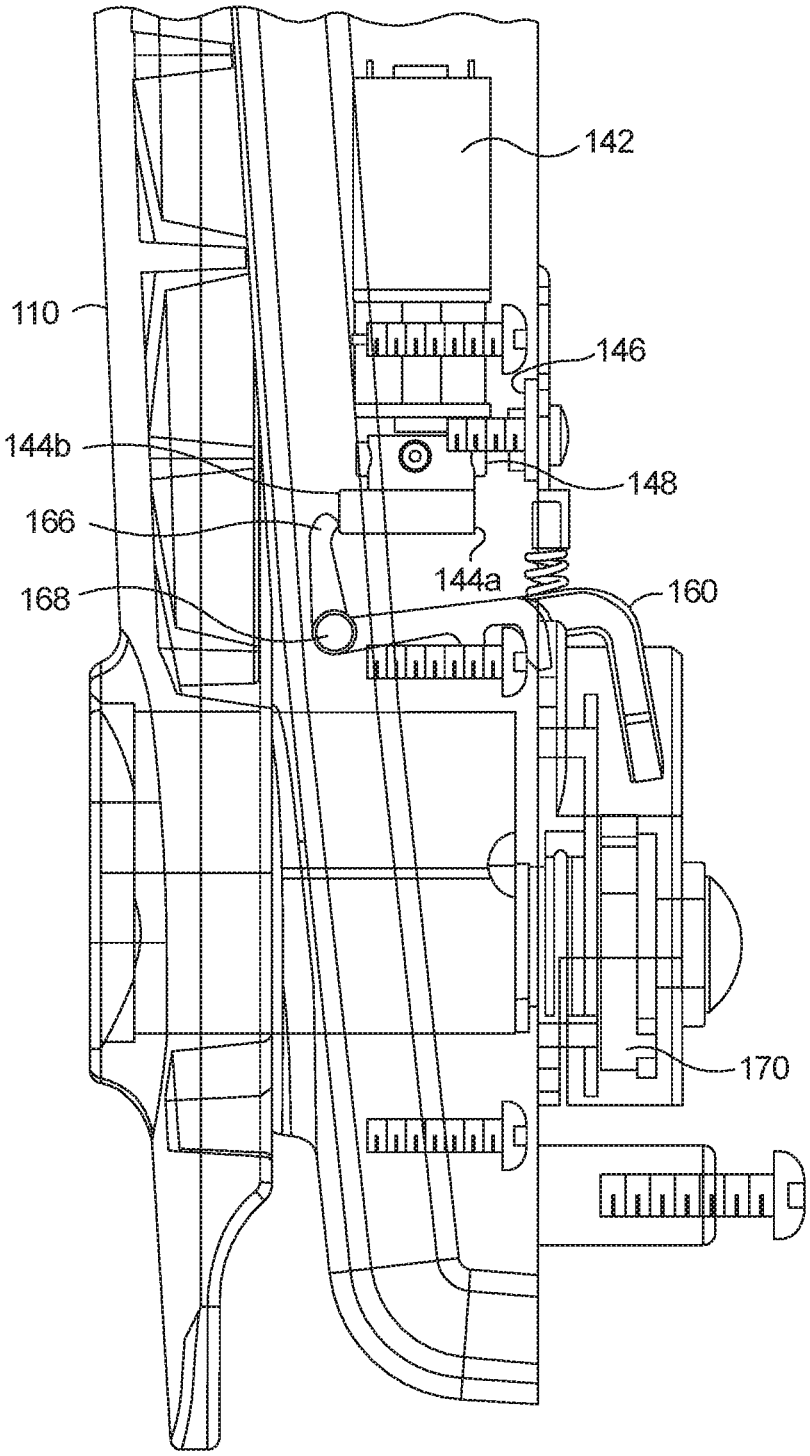
FIG. 7 is a detailed view of the locking mechanism of a first embodiment of a swivel lock system showing the mechanism in an unlocked state using the electronic actuator.

Returning to FIGS. 4 through 7, blocker 160 may further disengage from the handle by an electronic actuator acting upon the blocker. Energizing of motor 142 (for instance by an authenticated key card presented to electronic controller 140) initiates rotation of motor cam 144 to impinge upon a foot 166 of blocker 160 thereby causing the blocker to pivot about shaft axis 169 and to move toward its unblocking position. Pivoting of the blocker disengages locking teeth 162 from locking grooves 116 thus releasing the handle and allowing handle rotation to unlock the cabinet door. When the handle is in a locked state (as seen in FIG. 6), motor cam 144 has a low lobe 144*a* proximate blocker foot 166. With reference to FIG. 7, upon energizing of the motor, motor cam 144 rotates such that a high lobe 144*b* contacts and pushes on the blocker foot 166 to cause blocker 160 to rotate about axis 169. As the blocker continues to rotate about axis 169, locking teeth 162 disengage from locking grooves 116 to allow the handle to be rotated away from the housing. Electronic controller 140 is programmed to reverse the motor after a set period of time (for example, 5 seconds) thereby rewinding the motor cam such that the low lobe 144*a* is proximate the foot. Blocker spring 155 then returns the blocker 160 to the blocking position (FIG. 6).

The position of the low lobe and high lobe may be monitored by the electronic controller to ensure that the motor cam has the proper lobe directed toward the blocker foot depending upon whether a signal is sent to the motor by the controller to release or lock the handle. To this end, motor cam 144 is equipped with one or more magnets 148 which may be detected by a Hall Effect sensor 146 mounted on motor housing 141. For instance, a magnet having its north pole oriented outward may be located proximate the low lobe while a magnet having is south pole oriented outward may be located proximate the high lobe. Thus, depending upon the magnet polarity and/or strength detected by the Hall Effect sensor, the electronic controller can determine which lobe is directed toward the blocker foot. In this way, over-rotation of the motor cam may be prevented. For example, the motor may energize until the low lobe magnet is detected by the Hall Effect sensor signaling to the electronic controller that the apex of the high lobe of the motor cam is in contact with the blocker foot (see FIG. 7). The motor can then maintain the cam position for a user-selected period of time before reversing the motor cam until the high lobe is proximate the Hall Effect sensor and the low-lobe is proximate the blocker foot.

From the above description it can be seen that once the handle has been unlocked from the housing, either by way of electronic or manual actuation, the blocker is returned to its blocking position by reversing the motor or by self-centering of the lock cam. Thus, to relock the handle within the housing, one only needs to pivot the handle toward the housing and provide sufficient force to reset the locking teeth on the blocker within the locking grooves on the handle. As best shown in FIGS. 1, 2 and 6, to facilitate relocking of the handle and to prevent damage to the components, the leading faces of the teeth and grooves (as defined by the handle being directed into the housing) may be chamfered thereby providing a ramping effect wherein the locking teeth elevate slightly upon insertion of the handle until the teeth settle within their respective grooves. The trailing faces are not chamfered thus providing locking surfaces preventing the handle from being extracted from the housing while the teeth and grooves are engaged.

Figure 10:
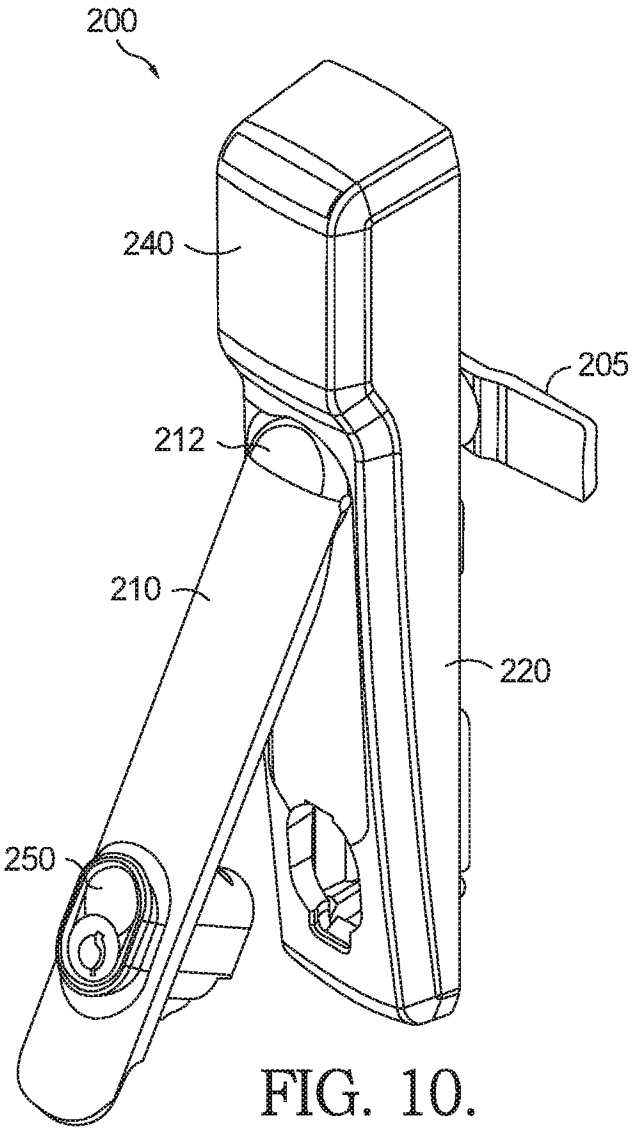
FIG. 10 is an isometric view of a second embodiment of a swivel lock system, with the handle in its released position.
Figure 9:
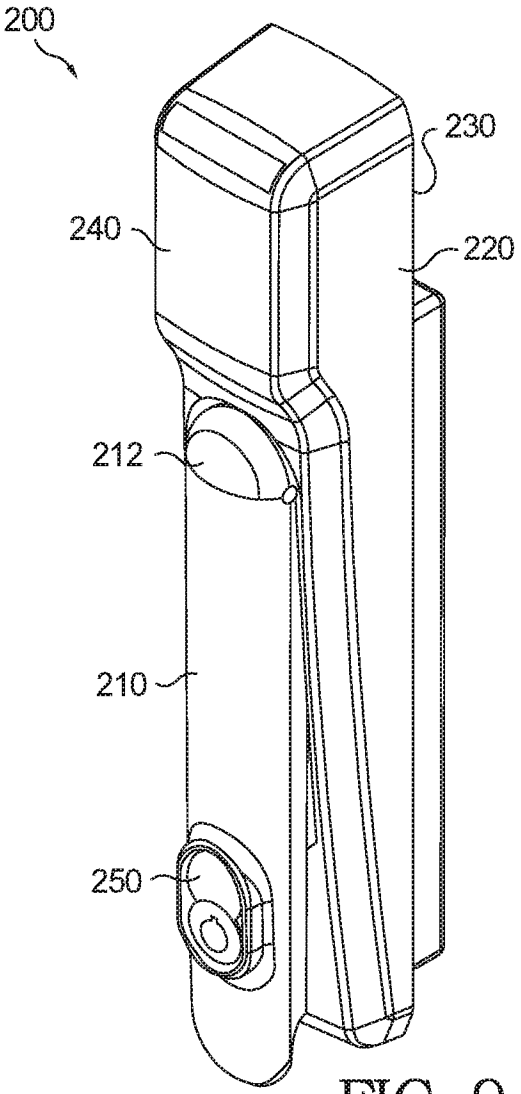
FIG. 9 is an isometric view of a second embodiment of a swivel lock system, with the handle in its secured position.
Figure 11:
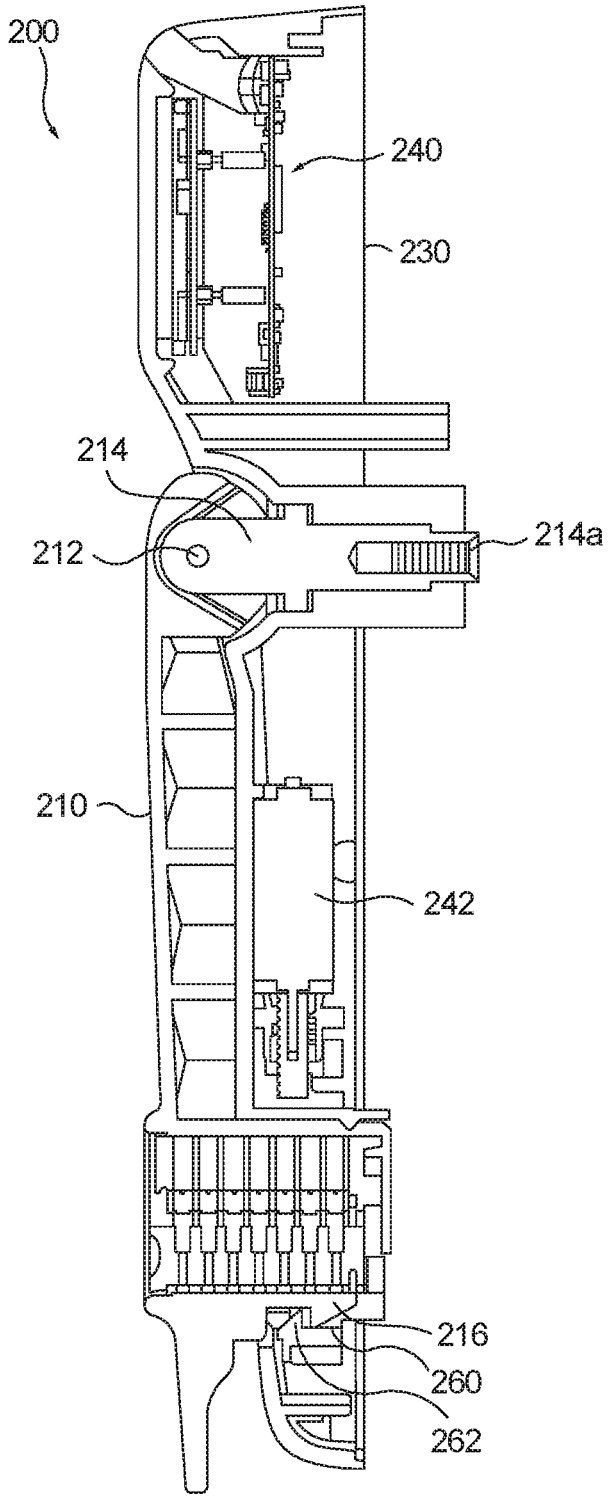
FIG. 11 is a cross sectional view from the side of a second embodiment of a swivel lock system.

Turning now to FIGS. 9 through 11, a second embodiment of a swivel lock assembly is generally referenced by numeral 200. Swivel lock assembly 200 is generally comprised of a handle 210 pivotally mounted to a lock housing 220 at handle pivot 212. When in a locked position (as shown in FIG. 9), handle 210 generally rests within lock housing 220 such that a first locking member, such as, for example, a locking tab 216, on handle 210 engages with a second locking member, such as, for example, blocker lock 262, of slide blocker 260 mounted within housing 220 (see FIG. 11). To unlock the handle, slide blocker 260 is moved towards its unblocking position to disengage blocker lock 262 from locking tab 216 by electrical actuation of motor 242 or manual actuation of lock core 250. Once slide blocker 260 has moved to its unblocking position so that locking tab 216 is no longer constrained by blocker lock 262, handle 210 can be released from the housing (as shown in FIG. 10) and swung away from the housing about handle pivot 212 similar to that of the first embodiment. Handle pivot 212 incorporates a drive yoke 214 which passes through housing 220. The distal end 214*a* of the drive yoke is adapted to mount a latch 205 similar to the mounting of latch 118 to yoke 114 wherein, when the handle is in a locked position (as shown in FIG. 10), the latch engages with a locking member within the cabinet housing such that the cabinet door is prevented from opening. When the lock is in an unlocked position and the handle is sufficiently pivoted, the latch is rotated such that the latch is no longer impeded by the locking member within the cabinet thereby allowing one to open the cabinet door and access the cabinet interior.

Housing 220 contains electrical and mechanical components of the locking system with a majority of these components being accessible by removal of back cover 230. Specifically, housing 220 integrates an electronic control unit 240 which energizes an electronic actuator such as motor 242, which may be a DC motor, upon verification of input of proper identification at the control unit 240. Electronic control unit 240 may be any suitable device known in the art, such as but not limited to a swipe card reader, key card scanner, key fob reader, fingerprint or retinal scanner, or voice recognition system.

Handle 210 further incorporates a lock core 250 which allows for manual manipulation of slide blocker 260 toward its unblocking position so as to depress the slide blocker and thereby cause blocker lock 262 to disengage from locking tab 216 on the handle. In one aspect of the invention, lock core 250 may be an SFIC, as described in reference to the first embodiment.

Lock core 250 includes a lock cam 270 (FIG. 12) such that rotation of the lock core (i.e. by manually turning a key) rotates the lock cam 270 thereby causing lock cam 270 to operate on surface 261 of slide blocker 260. Lock core 250 and lock cam 270 are secured within the handle 210 while the slide blocker 260 is mounted within housing 220.

Figure 12:
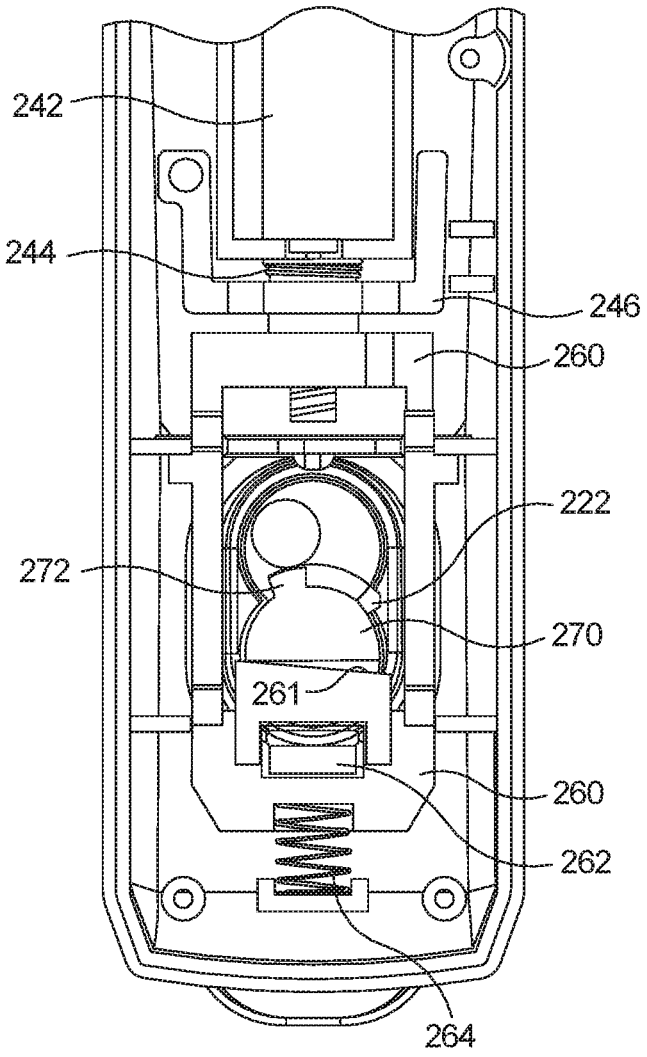
FIG. 12 is a detailed view of the locking mechanism of a second embodiment of a swivel lock system showing the mechanism in a locked state.

Turning now to FIG. 12, a detailed view of the blocker mechanism is shown in the locked orientation. The lock mechanism includes both electronic and manual actuators. Electronic actuation is controlled by electronic controller 240 (see FIGS. 10 and 11) energizing a motor 242. Manual actuation uses a lock cam 270 coupled to a lock core 250. Rotation of lock cam 270, by a key for example, causes cam 270 to act upon surface 261 of slide blocker 260 and, in turn, to move slide blocker 260 toward blocker spring 264 to allow disengagement of locking tab 216 from blocker lock 262 to permit handle 210 to be released from the housing. As shown in FIG. 12, when in a locked orientation, slide blocker 260 is biased upwardly towards its blocking position by blocker spring 264 such that blocker lock 262 may capture locking tab 216 (see FIG. 11).

Figure 13:
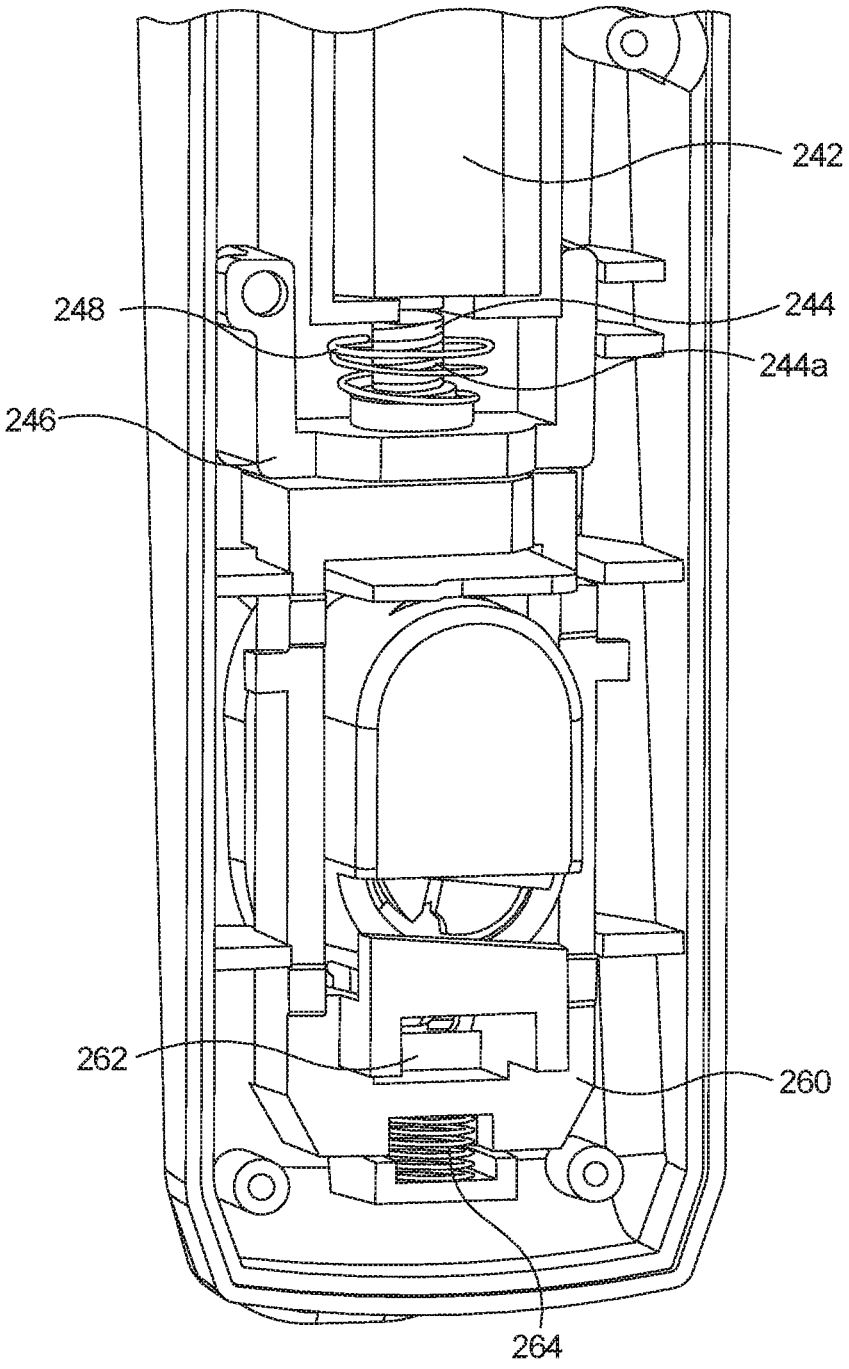
FIG. 13 is a detailed view of the locking mechanism of a second embodiment of a swivel lock system showing the lock cam mechanism in an unlocked state using the electronic actuator.

Electronic actuation of the locking mechanism is illustrated in FIG. 13. Energizing of motor 242 (for instance by an authenticated key card presented to electronic controller 240) initiates rotation of worm drive gear 244 in a first (for example, clockwise) direction. Threads 244*a* of worm drive gear 244 engage mating threads 246*a* of drive nut 246 (threads 244*a* and 246*a* are shown better in FIGS. 14A and 14B) and advance drive nut 246 downwardly as oriented in FIG. 12 so that slide blocker 260 moves downwardly as well. The downward movement of slide blocker 260 frees locking tab 216 from blocker lock 262, enabling the handle to be removed from the housing 220. After a user defined or manufacturer supplied default length of time (as measured by the control board of electronic controller 240), motor 242 is energized to rotate in an opposite (for example, counterclockwise) direction, thereby reversing rotation of the worm drive gear and, via the mating threads, moving drive nut 246 upwardly as oriented in FIG. 12. Upward travel of the drive nut permits slide blocker 260 to move upward under the biasing force of blocker spring 264 where the blocker lock 262 can once again engage the locking tab 216 on the handle. Once the handle is in the proper alignment with the housing, sufficient force applied to the handle toward the housing will snap the handle in place in the housing. The locking tab 216 impacts the blocker lock 262 to temporarily displace the slide blocker against spring 264 until the locking tab passes over the blocker lock. The slide blocker is then restored to the blocking position by the blocker spring. To assist the relocking movements of the locking tab and blocker lock, and decrease wear on the locking mechanism, one or both of the locking tab and blocker lock may be adapted to have a ramped surface as shown in FIG. 11.

Figure 14B:
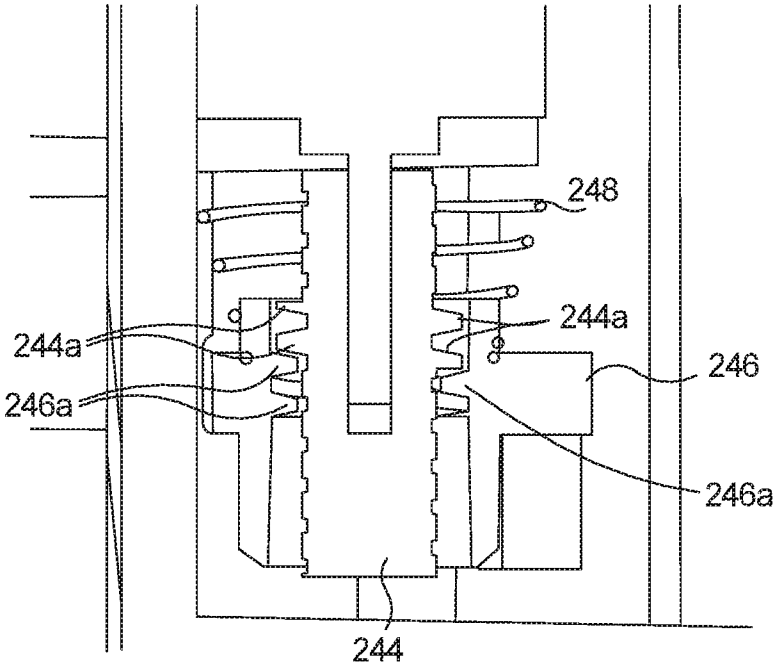
FIGS. 14A and 14B is an isolated view of the worm gear and drive nut of the second embodiment, in accordance with the invention.
Figure 14A:
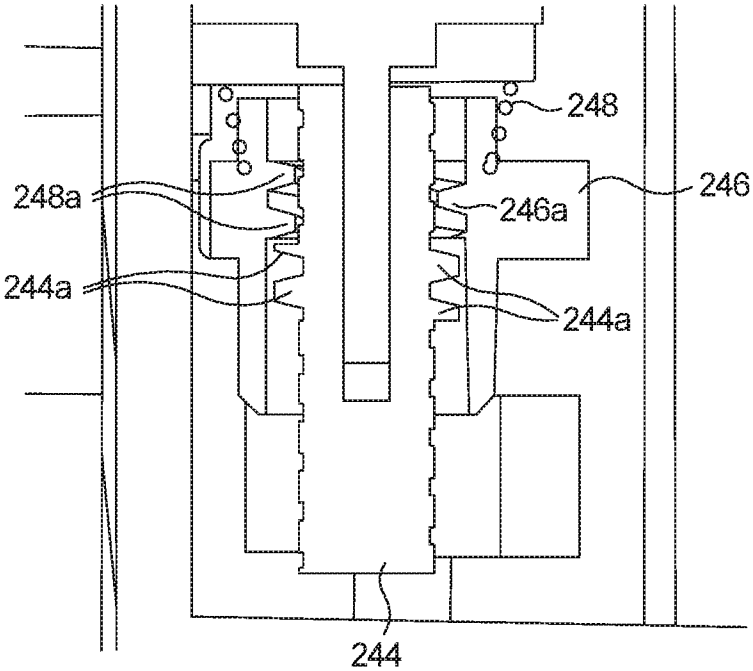

In one aspect of the present invention, the threads of worm drive gear 244 are formed so that the worm drive gear can only advance the drive nut or retract the drive nut far enough to disengage or engage the handle locking feature, respectively. That is, in accordance with this aspect of the invention, it is not necessary to detect the rotational position of the drive motor shaft to assure that the handle is either engaged with or disengaged from the housing. Referring to FIGS. 14A and 14B, the threads 246*a* of drive nut 246 become disengaged from the threads 244*a* of worm drive gear 244 following both upward and downward travel of the nut. As shown in more detail in FIG. 14A, drive nut 246 has a limited number of threads 246*a* which correspond to a limited number of threads 244*a* on worm drive gear 244. Thus, travel of drive nut 246 is limited to only that distance provided by the threaded portions of the nut and worm drive gear. Once the nut unthreads from the worm drive gear, continued rotation of the motor and worm drive gear do not induce further travel of the drive nut. In this manner, the drive nut decouples from the worm drive gear at specific points along linear travel. For instance, when the drive nut is being driven downwardly to move the slide blocker to release the handle, the drive nut travels only so far as to disengage the blocker lock from the locking tab before becoming decoupled from the worm drive gear. Conversely, the drive nut has controlled upward travel to a distance wherein the slide blocker causes engagement of the handle. At that point, the drive nut unthreads from the worm drive gear so that continued rotation of the motor and worm drive gear does not induce further travel of the drive nut. To this end, when in the "locked" orientation as shown in FIG. 14A, drive nut spring 248 provides sufficient downward pressure to overcome the force of blocker spring 264 so as to just engage threads 246*a* of the drive nut with the threads 244*a* of the worm drive gear. Thus, when motor 242 is energized to rotate the worm drive gear to move the drive nut downwardly (as oriented in FIG. 12), the lead thread of the worm drive gear will reengage the threads of the drive nut, initiating travel of the drive nut in a downward direction.

As shown in FIG. 14B, drive nut 246 has completed its downward travel along worm drive gear 244 to place the lock mechanism in the "unlocked" orientation. As discussed above with reference to FIG. 12, once the lock mechanism is in the unlocked orientation, blocker spring 264 is compressed due to the downward travel of the slide blocker. In the position of the drive nut shown in FIG. 14B, the drive nut unthreads from the worm drive gear so that continued rotation of the motor and worm drive gear does not induce further travel of the drive nut. The force of blocker spring 264 pushes upward on slide blocker 260 which, in turn, pushes upward on the drive nut. Thus, when motor 242 is energized to rotate the worm drive gear to move the drive nut upwardly (as oriented in FIG. 12), the lead thread of the worm drive gear will reengage the threads of the drive nut, initiating travel of the drive nut in an upward direction. Thus, it can be seen that, because the drive nut becomes decoupled from the worm drive gear at defined travel distances, but remains engaged with the worm drive gear by respective action of the drive nut spring (in the locked orientation) and the blocker spring (in the unlocked position), it is not necessary to precisely detect the rotational position of the drive motor shaft to assure engagement or disengagement of the handle from the housing.

Figure 15:
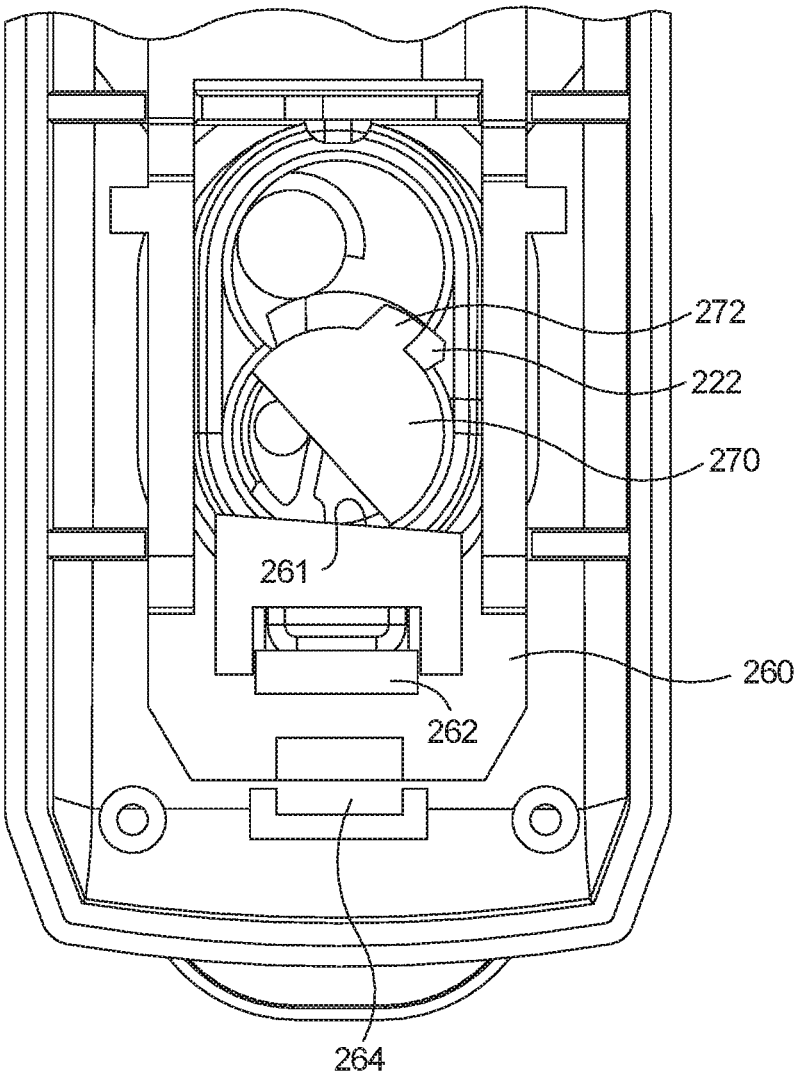
FIG. 15 is a detailed view of the locking mechanism of a second embodiment of a swivel lock system showing the lock cam mechanism in an unlocked state using the manual actuator.

Turning now to FIG. 15, manual actuation of the locking mechanism is shown. Lock cam 270, situated on lock core 250, has a generally semicircular cross section with the flat face of the semicircle contacting surface 261 of slide blocker

260. Projection 272 situated on lock cam 270 prevents over-rotation of the lock cam by impacting a post 222 on housing 220 after sufficient travel. When lock cam 270 is rotated to a sufficient degree (i.e. by actuation of a key within the lock core), the lock cam pushes against surface 261 of slide blocker 260 causing the slide blocker to move toward its unblocking position and toward blocker spring 264 such that the locking tab on the handle passes over the slide when the handle is pulled away from the housing. Once the force to rotate lock cam 270 is removed, the force of blocker spring 264 applied to slide blocker 260 returns lock cam 270 to its "locked" position.

In one aspect of the present invention, the lock cam is carried by the lock core which in turn is carried by the handle. Thus, once the handle has been released from the housing, the force applied by the lock cam to the slide blocker is removed thereby allowing the slide blocker to return to the blocking position by operation of blocker spring 264. To re-secure the handle to the housing (after the handle has been returned to its proper orientation relative to the housing), sufficient force needs to be applied to the handle to snap the handle into its secured position. By applying a sufficient force, locking tab 216 contacts blocker lock 262 to displace the blocker lock against blocker spring 264 until the locking tab passes over the blocker lock and the slide blocker is restored to the blocking position by the blocker spring.

In both embodiments, manual actuation of the lock cam, such as through operation of a key, independently operates to unlock the handle from the housing and does not require any user input to the electronic control unit. Thus, in the case of power interruption or outages, access to the cabinet interior is possible through manual activation.

Figure 16A:
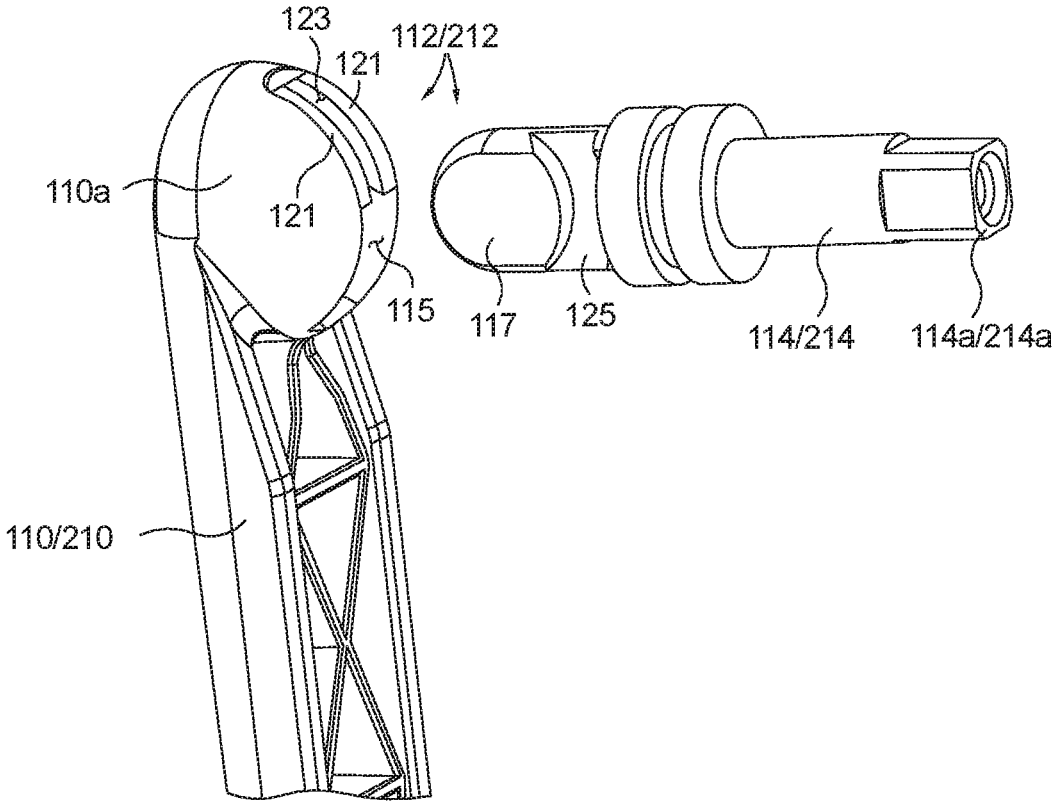
FIGS. 16A and 16B are views of the optional handle attachment feature, in accordance with the invention.
Figure 16B:
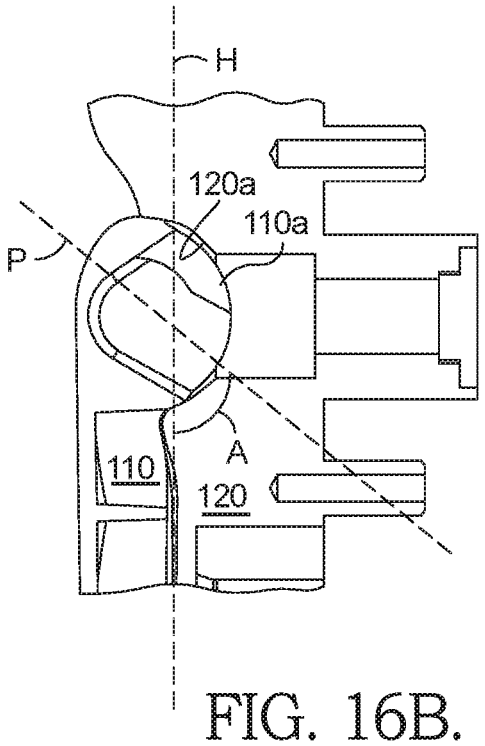

In a further aspect of the present invention, the pivoting handle is constructed without requiring a pivot pin or other external fastening means to pivotally secure the handle to the yoke. With respect to this attachment feature, both the handle and yoke may be net-formed, without the requirement of extra machining to provide for the attachment. As shown in FIGS. 16A and 16B, the pivoting handle 110/210 of the present invention may have a pivot 112/212 between the top portion of the handle and a yoke 114/214. The distal end 114*a*/214*a* of the yoke is adapted to secure a latch to the handle, as described above. For the sake of clarity, the following description will be directed toward the embodiment shown and described with regard to FIGS. 1-8 with the understanding that the present handle may be used with any suitable locking system and is not to be interpreted as limiting in any way. Turning again now to FIGS. 16A and 16B, the upper end 110*a* of handle 110 is generally spherical in shape and is adapted to fit snuggly within a semi-spherical indent 120*a* in housing 120. Handle end 110*a* is configured with a pocket 115 adapted to receive a flattened bulb end 117 of yoke 114. Along the edge of a portion of pocket 115 is a pair of generally parallel sidewalls 121 defining a channel 123 that is narrower than pocket 115. Bulb end 117 of yoke 114 includes a narrower neck portion which creates a bridge 125 wherein, when the bulb end is inserted into pocket 115 and then the neck portion is pivoted toward channel 123, bridge 125 slides into channel 123 and flattened bulb end 117 becomes trapped below the narrow channel. Thus, bulb end 117 is captured within the pocket by sidewalls 121. As seen in FIG. 16B, channel 123 is formed within handle end 110*a* such that the central plane P of the pocket 115 creates an acute angle A with plane H formed by the handle 110 and housing 120. Angle A is selected such that when yoke end 114*a* is assembled to a handle within a swivel lock assembly, lifting and pivoting of handle 110 under normal operation of the assembly does not, and cannot, cause bridge 125 to become out of engagement with channel 123 to detach the handle from the yoke. To detach the handle from the yoke, the yoke and handle must first be removed from the housing. Only once the yoke and handle are removed from the housing can the handle be rotated to the proper angle to disengage the bridge 125 from the channel 123 so that the bulb end 117 can slide out of the pocket 115 without being trapped by sidewalls 121.

Figure 17:
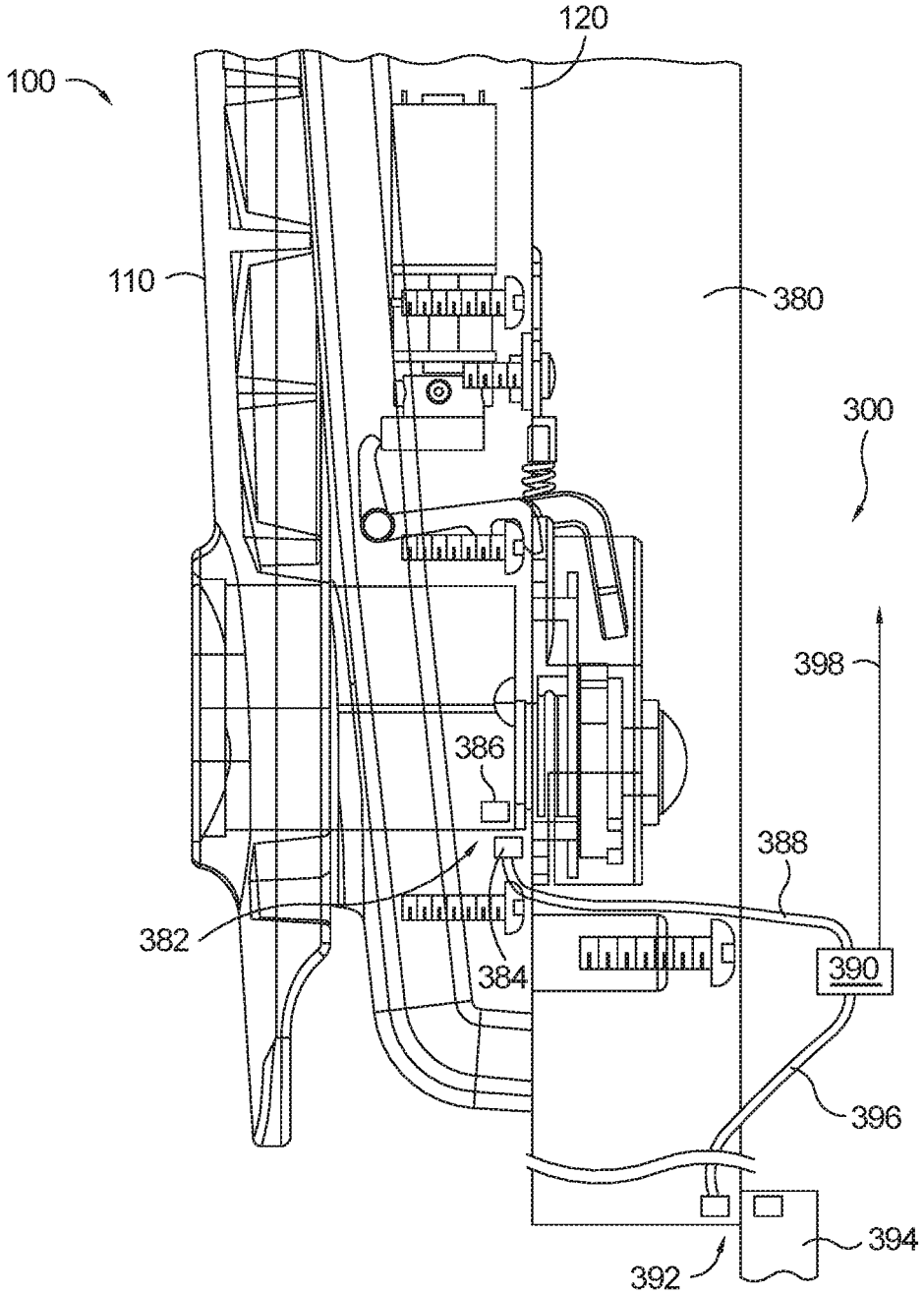
FIG. 17 is a detailed view of a swivel lock system showing a locked status monitoring feature in accordance with the invention.

Currently in the art, by seating the handle in the housing, the latch is placed in the proper orientation to secure an associated compartment such as a computer server cabinet enclosure. However, at that point, the cabinet enclosure may not be secured. For example, if the cabinet door is not first closed before seating the handle, the latch may have not engaged the cabinet frame enclosure and a false indication could be provided that the cabinet enclosure was properly secured. To remedy this situation, a locked status monitoring feature 300 is herein disclosed. Referring to FIG. 17, a locking assembly of the first embodiment is shown. In this view, assembly 100 is shown mounted to cabinet door 380. Handle 110 is fully seated in housing 120. Sensor 382, which is shown as a Hall Effect sensor 384 and magnet 386, but could be any other type of switch known in the art such as a reed switch, a micro switch, a contact switch or the like, is disposed in the locking assembly so as to provide a signal 388 to controller circuit 390 whenever handle 110 is fully seated in housing 120. A second sensor 392, that similarly may be any type of switch known in the art such as a Hall Effect sensor switch, a reed switch, a micro switch, a contact switch or the like, is disposed in the cabinet to sense when door 380 is fully closed against cabinet frame 394. Second sensor 392 provides a signal 396 to controller circuit 390 whenever door 380 is fully closed. When controller circuit simultaneously receives signals 388 and 396, a confirming signal 398 is sent to a control panel indicating that the cabinet enclosure being monitored is fully secured. Confirming signal 398 can be used, for example, to illuminate a confirmation light, to create and audible confirmation alarm or to send a readable message in confirmation. Or the circuitry can be configured to trigger an alarm only if one of the two signals 388/396 is received by controller circuit 390. In like fashion, any number of sensors may be positioned within the cabinet enclosure to detect other "false" secure situations whereby only when simultaneous signals from the multiple sensors are received by the controller circuit will a confirming signal be sent to the control panel. While feature 300 is shown in connection with assembly 100, it is understood that it may be used in connection with assembly 200 or any other swivel lock assembly available on the market.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method of operating a lock, the lock having an electric motor actuator, a worm gear rotatable by said electric motor actuator and a drive nut, wherein said worm gear includes first threads and a first unthreaded portion extending beyond said first threads at a first end of said worm gear, wherein said drive nut includes second threads matable with said first threads, wherein said drive nut is movable by said rotation of said worm gear when said first threads are mated with said second threads of said drive nut to selectively change a lock state of said lock to a locked state or an unlocked state, said method comprising the steps of:

a) engaging said drive nut with said worm gear so that said first threads mesh with said second threads;

b) operating said motor actuator in a first rotational direction so that said worm gear moves said drive nut toward said first unthreaded portion;

c) changing said state of said lock from said locked state to said unlocked state by moving said drive nut toward said first unthreaded portion; and d) moving said drive nut onto said first unthreaded portion, so as to cause disengaging of said first threads from said second threads by continued operation of said motor actuator in said first rotational direction, thereby automatically disengaging said drive nut from said worm gear after a predetermined length of travel of said drive nut irrespective of continued operation of said motor actuator.

2. The method according to claim 1 wherein said worm gear includes a second unthreaded portion extending beyond said first threads at a second end of said worm gear opposite said first end, said method comprising the further steps of:

e) after step d), operating said motor actuator in a second rotational direction opposite said first rotational direction;

f) re-engaging said first threads with said second threads;

g) continuing operation of said motor actuator in said second rotational direction;

h) changing said state of said lock from said unlocked state to said locked state by moving said drive nut toward said second unthreaded portion; and i) moving said drive nut onto said second unthreaded portion, so as to cause disengaging of said first threads from said second threads by continued operation of said motor actuator in said second rotational direction, thereby automatically disengaging said drive nut from said worm gear after said predetermined length of travel of said drive nut irrespective of continued operation of said motor actuator.

* * * * *